US011415386B1

(12) United States Patent
Lee et al.

(10) Patent No.: US 11,415,386 B1
(45) Date of Patent: Aug. 16, 2022

(54) BI-DIRECTIONAL FOLDABLE FIREARM STOCK

(71) Applicants: Shanyao Lee, Santa Ana, CA (US); Chien-Yuan Cheng, New Taipei (TW)

(72) Inventors: Shanyao Lee, Santa Ana, CA (US); Chien-Yuan Cheng, New Taipei (TW)

( * ) Notice: Subject to any disclaimer, the term of this patent is extended or adjusted under 35 U.S.C. 154(b) by 57 days.

(21) Appl. No.: 17/193,382

(22) Filed: Mar. 5, 2021

(51) Int. Cl.
*F41C 23/04* (2006.01)

(52) U.S. Cl.
CPC ..... *F41C 23/04* (2013.01)

(58) Field of Classification Search
CPC ..... F41C 23/04; F41C 23/14; F41C 27/06; F41A 3/84; F41A 11/02; F41A 3/66; F41A 11/04; F41A 19/10; F41A 3/26; F41A 35/06
USPC ..... 42/73, 1.06, 71.01, 72, 74, 71.02, 42/75.01–75.1; 89/191.01, 193, 198
See application file for complete search history.

(56) References Cited

U.S. PATENT DOCUMENTS 4,513,523 A * 4/1985 Gal ..... F41C 23/04 42/72
4,640,036 A * 2/1987 Gal ..... F41C 23/00 D22/104
4,735,007 A * 4/1988 Gal ..... F41C 23/00 D22/104
4,766,800 A * 8/1988 Miller ..... F41A 9/65 89/33.02
2009/0288324 A1* 11/2009 Peterson ..... F41C 23/20 42/74
2011/0131857 A1* 6/2011 Kuczynko ..... F41C 23/04 42/73
2012/0137562 A1* 6/2012 Langevin ..... F41C 23/04 42/75.03
2014/0026745 A1* 1/2014 Lee ..... F41A 3/78 89/198
2014/0075815 A1* 3/2014 Jarboe ..... F41C 23/06 42/73
2014/0331539 A1* 11/2014 Malik ..... F41C 23/14 42/73
2016/0202016 A1* 7/2016 Mather ..... F41C 23/14 42/73
2017/0356712 A1* 12/2017 Johnson ..... F41C 7/11
2018/0195822 A1* 7/2018 Jonsson ..... F41A 3/66
2020/0200505 A1* 6/2020 Brown, Jr. ..... F41C 27/00
2021/0215451 A1* 7/2021 Ding ..... F41C 23/14
2021/0222993 A1* 7/2021 Morenz ..... F41C 23/04

* cited by examiner

*Primary Examiner* — Michael D David
(74) *Attorney, Agent, or Firm* — Che-Yang Chen; Law Office of Michael Chen

(57) ABSTRACT

In one aspect, a bi-directional foldable stock for a firearm may include a stock-to-firearm adaptor configured to be an interface to connect the firearm and the stock. The adaptor may include a base and a movable top portion that is pivotally and detachably engaged with the base. The top portion is attached to the firearm while the base is connected to the stock. The base with the stock is configured to pivotally rotate either in a clockwise or counter-clockwise manner to fold the stock on either sides of the firearm.

12 Claims, 14 Drawing Sheets

BI-DIRECTIONAL FOLDABLE FIREARM STOCK

FIELD OF THE INVENTION

The present invention relates to a firearm stock, and more particularly relates to a bi-directional foldable firearm stock that is easy for the user to operate.

BACKGROUND OF THE INVENTION

Since the advent of shoulder-fired weaponry, such as guns, the use of a stock for holding the barrel and firing mechanisms of the weapon has been a standard practice. Typically, a stock made of wood, plastic, or metal extended rearward from the firing mechanism some finite distance creating the "gun butt" or "butt stock" portion. This butt stock portion was used to stabilize the weapon. The user would press the butt stock into his or her shoulder while taking aim and firing the weapon.

In recent firearm design, a folding stock assembly has played an important role. The folding stock assembly in many designs requires the user translate the folding stock along an axis prior to and/or during rotation about that axis (e.g., a vertical axis). Requiring the user translate the stock on the axis reduces the reliability of the weapon itself and increases the complexity of use of the weapon.

In another example, a folding stock generally has a folded configuration and an unfolded configuration, with the same locking mechanism being used to selectively maintain the stock assembly in the folded and unfolded configurations. Using the same lock for maintaining both configurations limits the freedom of the designer to control folding and unfolding forces.

U.S. Pat. No. 10,156,421 to Smith et al. discloses a stock for a firearm, which is configured for bi-directional folding to either side of a receiver of the firearm. However, when the stock changes from one folded configuration to another folded configuration, the user has to manually switch the mounting pins to change one folded configuration to another, which is inconvenient to the user, reduces the reliability of the firearm itself, and increases the complexity to operate the firearm. Therefore, there remains a need for a new and improved bi-direction foldable firearm stock to overcome the problems stated above.

SUMMARY OF THE INVENTION

In one aspect, a stock-to-firearm adaptor may include a base and a movable top portion that is pivotally and detachably engaged with the base. In one embodiment, the top portion may include a first button and a second button which are resiliently connect to the top portion and configured to control the position and movement of the top portion. Namely, each of the first button and second button can be pressed down to a predetermined position and can restore to its original position through a resilient force when it is released. For example, when the first button is pressed, the top portion disengages from the base and can be lifted on a first side of the adaptor while the adaptor is still pivotally connected with the base on a second side, so the top portion can be lifted and rotate through the pivotal connection on the second side. Likewise, when the second button is pressed, the top portion can also disengage from the base and can be lifted on the second side of the adaptor and rotate through the pivotal connection on the first side.

More specifically, the top portion on the first side may include a first engaging groove, which may include two side grooves and a center groove. It is noted that the center groove is formed at an inner portion of the first button and when the button is not pressed, the center groove is actually misaligned with the two side grooves. The first engaging groove is configured to engage with a first connecting bar at the base, while a second engaging groove is configured to engage with a second connecting bar at the base to at least pivotally secure one side of the top portion to the base. It is noted that when the first button is pressed, the center groove is aligned with the two side grooves to form the first engaging groove, and when the first engaging groove is formed, the top portion can either engage or disengage with the first connecting bar at the base on the first side to either secure the top portion to the base on the first side, or lift the top portion from the base on the first side.

It is noted when the first button is released, the center groove again misaligns with the two side grooves to secure the connecting bar. Furthermore, a first stopping edge is formed near the center groove, and the connecting bar would be blocked by the first stopping edge when the first button is released to prevent the first connecting bar from inadvertently disengaging from the first engaging groove. In one embodiment, the first stopping edge may include an evading surface to facilitate the engagement of the first engaging groove and the first connecting bar.

The top portion may further include a position securing unit which is resiliently connected of the top portion at a lower sidewall thereof and located between the lower sidewall of the top portion and one side of an inner sidewall of the base. More specifically, when the top portion is engaged with the base, the position securing unit is pressed into the lower portion of the top portion to form a portion of the lower sidewall of the top portion, which is between the top portion and one side of the inner sidewall of the base. For example, when the top portion is lifted and extends by rotating away from the first side, a portion of the position securing unit pops out from the lower sidewall of the top portion because of the resilient force, while the other portion thereof is still pressed by the inner sidewall of the base.

As more of the top portion pivotally rotating away from the first side, more portions of the position securing unit pop out. The top portion can rotate 180 degrees from the first side and is fully extended. More importantly, the position securing unit fully pops out at this time and is blocked by an outer edge of the base, so the top portion can no longer be moved. Namely, when the top portion is fully extended away from the first side, the position securing unit is blocked by the outer edge of the base and acts as a lock to secure the fully extended position of the top portion.

Likewise, the top portion can be lifted from the second side, while the first engaging groove is engaging with the first connecting bar to pivotally connect the top position to the first side of the base. More specifically, the top portion on the second side may include a second engaging groove, which may include two side grooves and a center groove. It is noted that the center groove is formed at an inner portion of the second button and when the button is not pressed, the center groove is actually misaligned with the two side grooves. Similarly, when the second button is pressed, the center groove is aligned with the two side grooves to form the second engaging groove, and when the first engaging groove is formed, the top portion can either engage or disengage with the second connecting bar at the base on the second side to either secure the top portion to the base on the second side, or lift the top portion from the base on the first side.

It is noted when the second button is released, the center groove again misaligns with the two side grooves to secure the second connecting bar. Furthermore, a second stopping edge is formed near the center groove, and the second connecting bar would be blocked by the second stopping edge when the second button is released to prevent the second connecting bar from inadvertently disengaging from the second engaging groove. In one embodiment, the stopping edge may include an evading surface to facilitate the engagement of the second engaging groove and the second connecting bar.

Likewise, the top portion can be lifted up and away from the second side of the base while the other side is pivotally connected to the first connecting bar of the base through the first connecting groove. As more of the top portion pivotally rotating away from the second side, more portions of the position securing unit pop out. The top portion can rotate 180 degrees from the second side and is fully extended. More importantly, the position securing unit fully pops out at this time and is blocked by an outer edge of the base, so the top portion can no longer be moved. Namely, when the top portion is fully extended away from the second side, the position securing unit is blocked by the outer edge of the base and acts as a lock to secure the fully extended position of the top portion.

It is noted that the stock-to-firearm adaptor is configured to be an interface of the firearm and the stock. In one embodiment, the base may include a stock receiving hole to receive a stock, while the top portion may include a firearm attaching assembly to couple the top portion to a firearm.

By pressing either the first button or the second button, the top portion can rotate through the pivotal connection of the top portion and the base on the second side and the first side, respectively. In other words, if the top portion is fixed, the base can also rotate through the pivotal connection of the top portion and the base. In one embodiment, the adaptor is fixed to the firearm through the firearm attaching assembly and user can press the second button to disengage the second engaging groove and the second connecting bar, so the base along with the stock can be rotated in a clockwise manner to one side of the firearm, and when the base with the stock rotates 180 degrees, the position securing unit pop out to lock the base with the stock to the fully extended position on one side of the firearm.

Similarly, the user can press the first button to disengage the first engaging groove and the first connecting bar, so the base along with the stock can be rotated in a counter-clockwise manner to the other side of the firearm, and when the base with the stock rotates 180 degrees, the position securing unit pop out to lock the base with the stock to the fully extended position on the other side of the firearm.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As used in the description herein and throughout the claims that follow, the meaning of “a”, “an”, and “the”

includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

Figure 1:
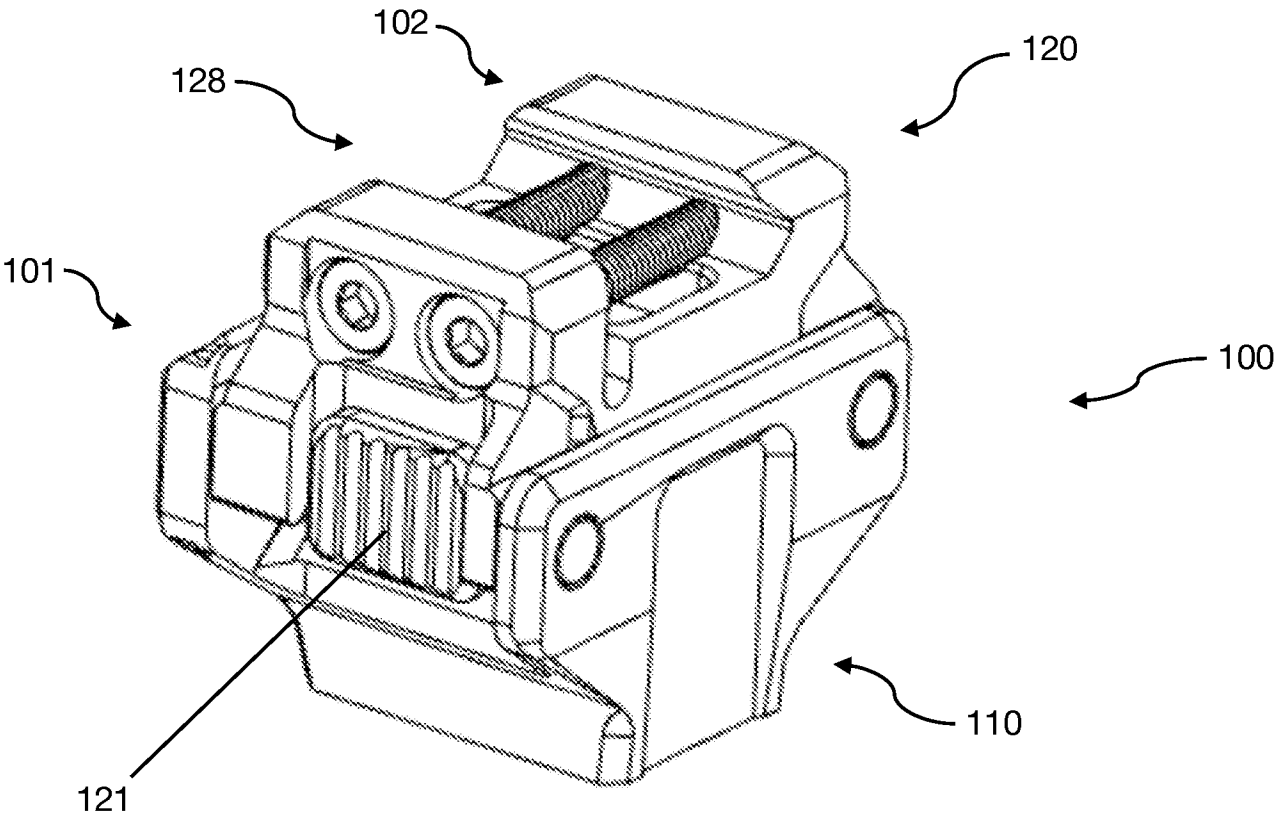
FIG. 1 is a schematic view of a stock-to-firearm adaptor on the first side in the present invention.
Figure 2:
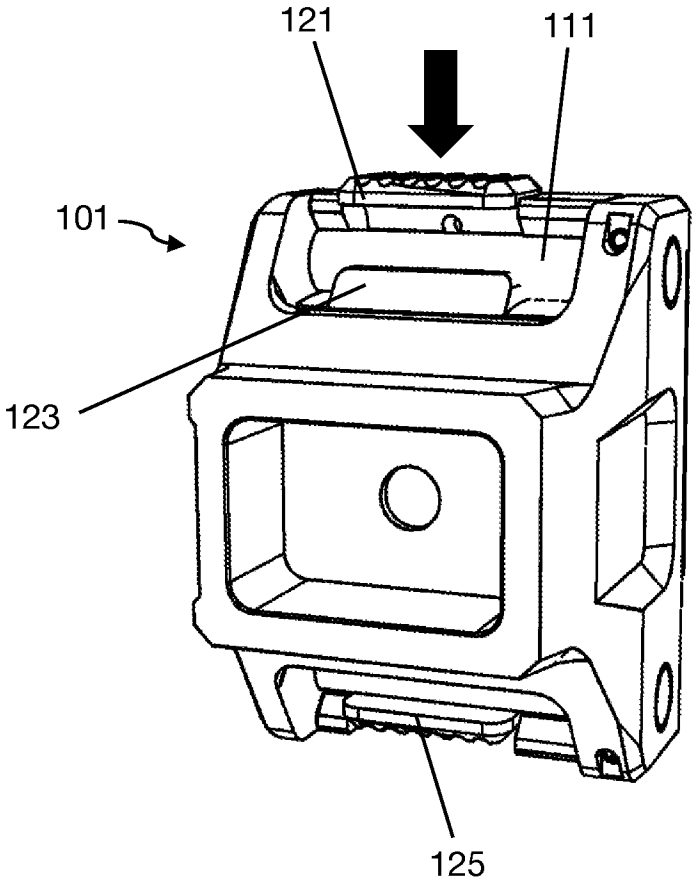
FIG. 2 is a schematic view of the stock-to-firearm adaptor when the first button is pressed to start lifting the top portion away from the base in the present invention.
Figure 3:
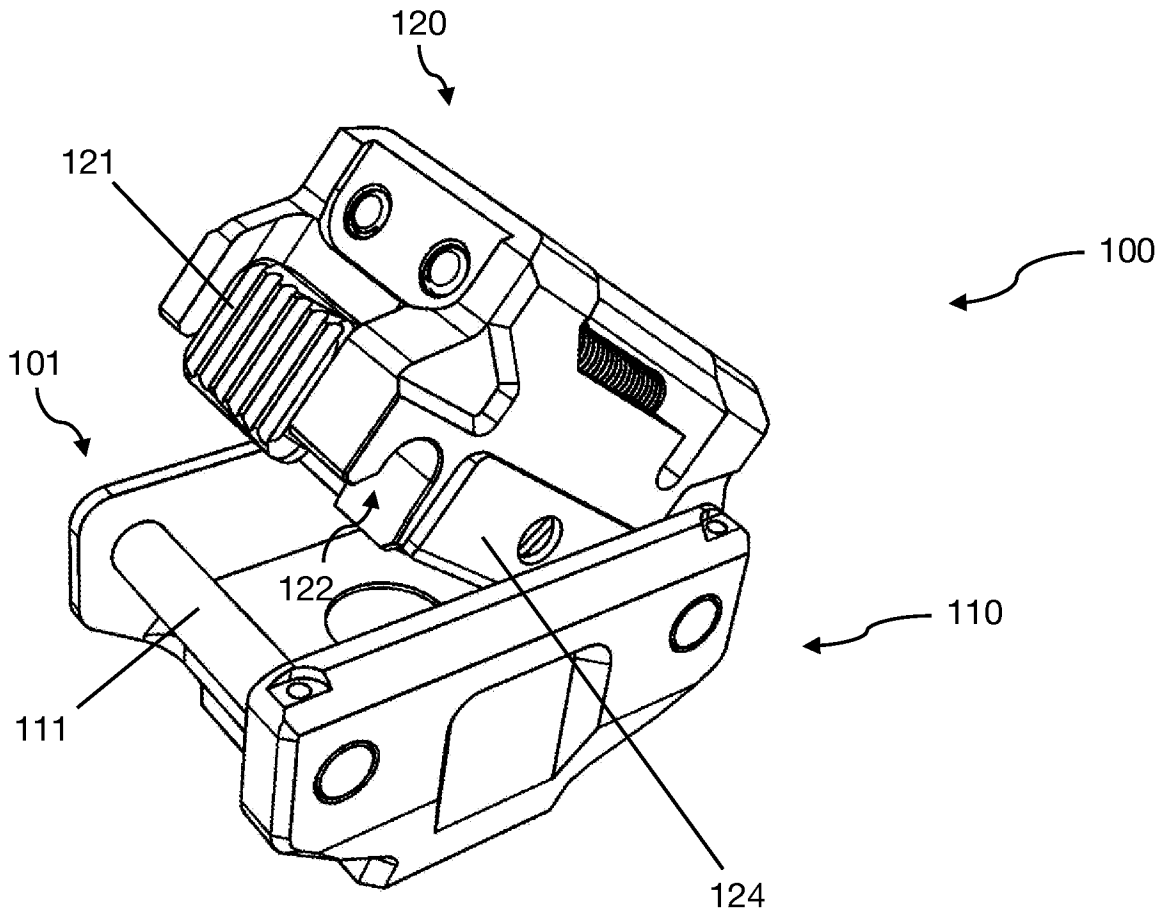
FIG. 3 is a schematic view of the stock-to-firearm adaptor when the top portion is lifted away from the first side in the present invention.
Figure 8:
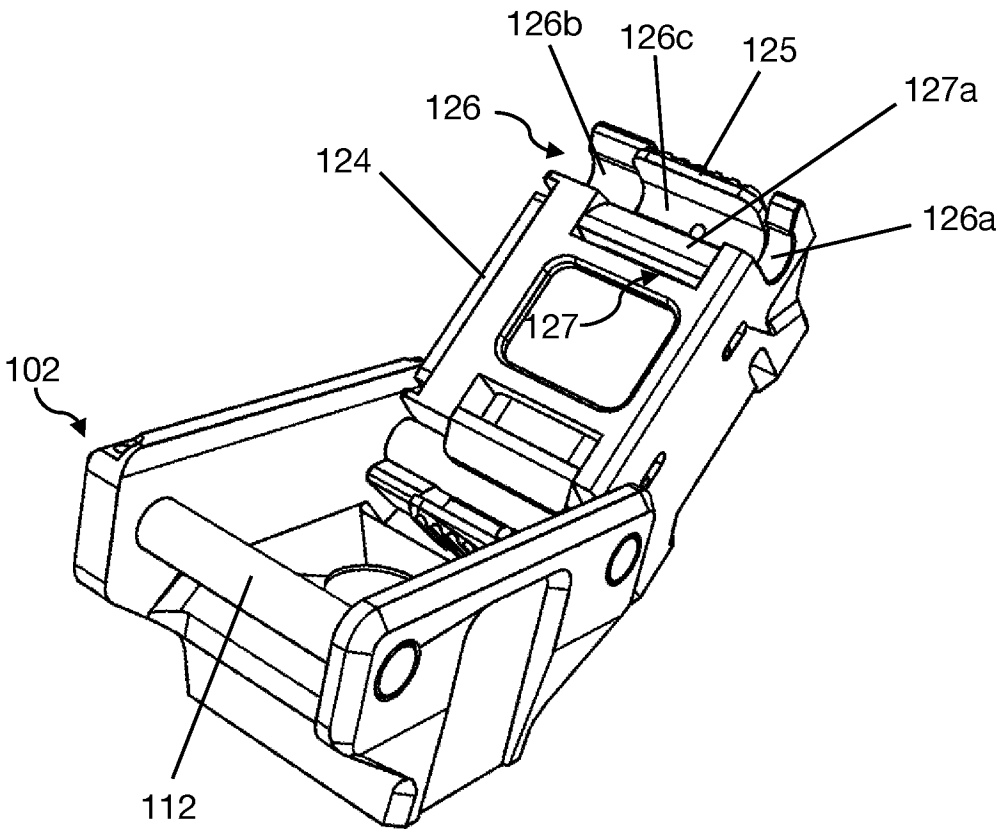
FIG. 8 is a schematic view of the stock-to-firearm adaptor when the top portion is lifted away from the second side and rotated toward the fully extended position in the present invention.

In one aspect, referring to FIGS. 1 to 5, a stock-to-firearm adaptor 100 may include a base 110 and a movable top portion 120 that is pivotally and detachably engaged with the base 110. In one embodiment, the top portion 120 may include a first button 121 and a second button 125 which are resiliently connect to the top portion and configured to control the position and movement of the top portion 120. Namely, each of the first button 121 and second button 125 can be pressed down to a predetermined position and can restore to its original position through a resilient force when it is released. For example, when the first button 121 is pressed as shown in FIG. 2, the top portion 120 disengages from the base 110 and can be lifted on a first side 101 of the adaptor 100 as shown in FIG. 3 while the adaptor 100 is still pivotally connected with the base on a second side 102, so the top portion 120 can be lifted and rotate through the pivotal connection on the second side 102. Likewise, when the second button 125 is pressed, the top portion 120 can also disengage from the base 110 and can be lifted on the second side 102 of the adaptor 100 and rotate through the pivotal connection on the first side 101 as shown in FIG. 8.

Figure 4:
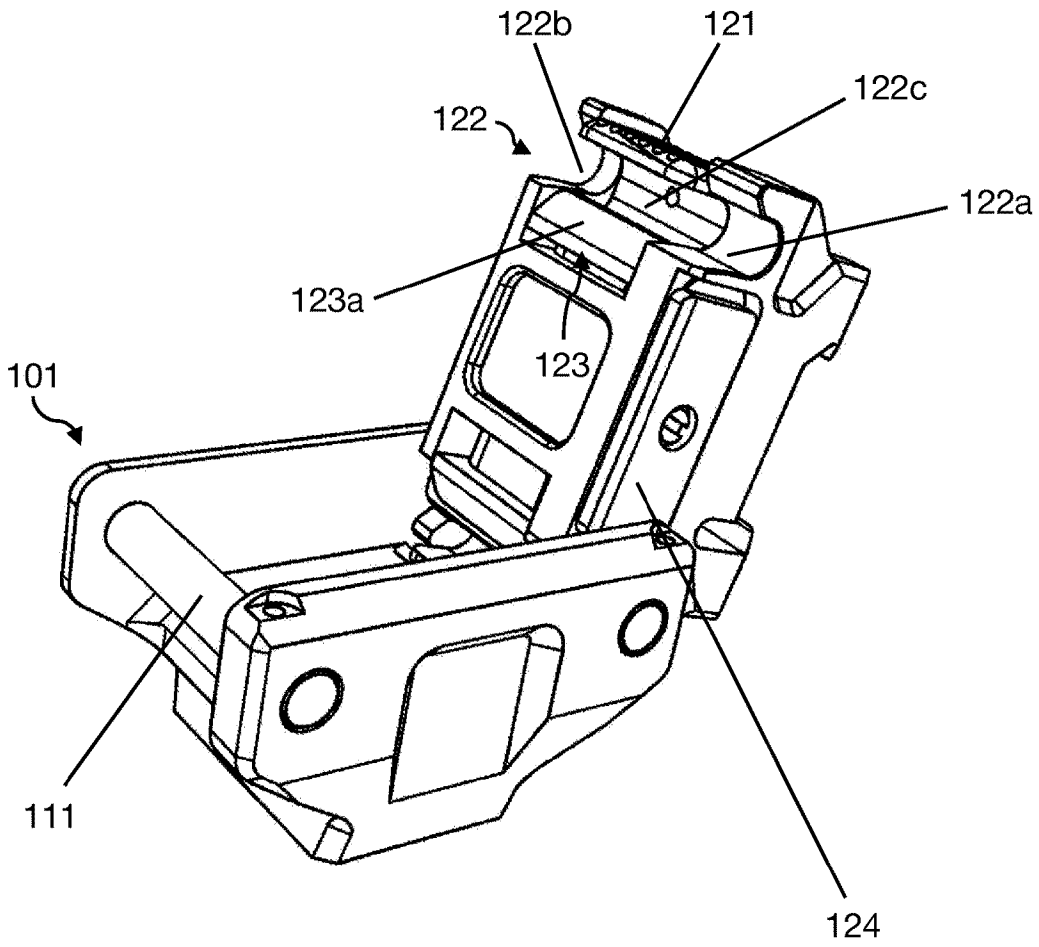
FIG. 4 is a schematic view of the stock-to-firearm adaptor when the top portion is lifted away from the first side and rotated toward the fully extended position in the present invention.
Figure 5:
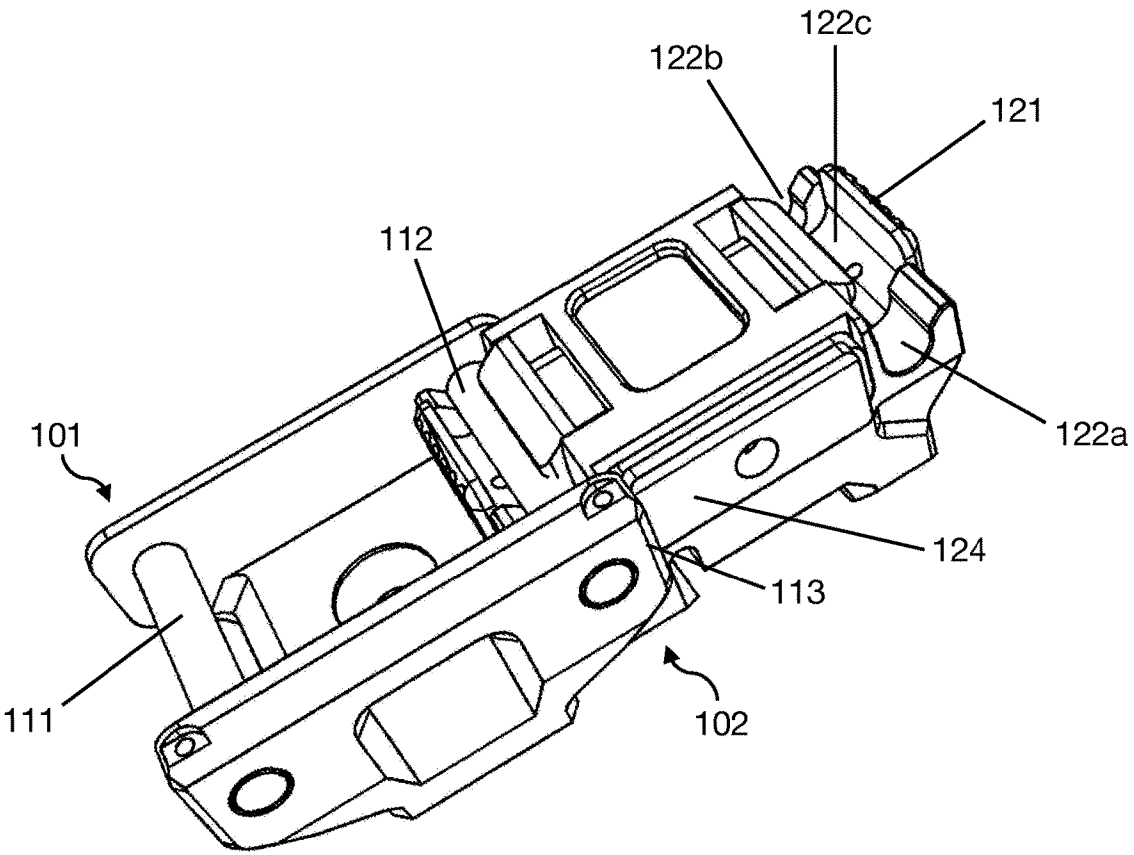
FIG. 5 illustrates a schematic view of the stock-to-firearm adaptor when the top portion is lifted away from the first side and reaches the fully extended position in the present invention.

More specifically, as shown in FIGS. 2 to 5, the top portion 120 on the first side 101 may include a first engaging groove 122, which may include two side grooves (122*a*, 122*b*) and a center groove 122*c*. It is noted that the center groove 122*c* is formed at an inner portion of the first button 121 and when the button 121 is not pressed, the center groove 122*c* is actually misaligned with the two side grooves (122*a*, 122*b*) as shown in FIG. 5. The first engaging groove 122 is configured to engage with a first connecting bar 111 at the base 110, while a second engaging groove 126 is configured to engage with a second connecting bar 112 at the base 110 (see FIGS. 7 and 8) to pivotally secure one side of the top portion 120 to the base 110 respectively. It is noted that when the first button 121 is pressed, the center groove 122*c* is aligned with the two side grooves (122*a*, 122*b*) to form the first engaging groove 122 as shown in FIG. 4, and when the first engaging groove 122 is formed, the top portion 120 can either engage or disengage with the first connecting bar 111 at the base 110 on the first side 101 to either secure the top portion 120 to the base 110 on the first side 101, or lift the top portion 120 from the base 110 on the first side 101 as shown in FIG. 3.

It is noted when the first button 121 is released, the center groove 122*c* again misaligns with the two side grooves (122*a*, 122*b*) to secure the connecting bar 111. Furthermore, a first stopping edge 123 is formed near the center groove 122*c*, and the connecting bar 111 would be blocked by the first stopping edge 123 when the first button 121 is released to prevent the first connecting bar 111 from inadvertently disengaging from the first engaging groove 122 as shown in FIG. 2. In one embodiment, the first stopping edge 123 may include a first evading surface 123*a* to facilitate the engagement of the first engaging groove 122 and the first connecting bar 111 as shown in FIG. 4.

The top portion 120 may further include a position securing unit 124 which is resiliently connected of the top portion 120 at a lower sidewall thereof and located between the lower sidewall of the top portion 120 and one side of an inner sidewall of the base 110. More specifically, when the top portion 120 is engaged with the base 110, the position securing unit 124 is pressed into the lower portion of the top portion 120 to form a portion of the lower sidewall of the top portion 120, which is between the top portion 120 and one side of the inner sidewall of the base 110. As shown in FIG. 3, for example, when the top portion 120 is lifted and extends by rotating away from the first side 101, a portion of the position securing unit 124 pops out from the lower sidewall of the top portion 120 because of the resilient force, while the other portion thereof is still pressed by the inner sidewall of the base 110.

As can be seen in FIGS. 3 to 5, as the top portion 120 pivotally rotating away from the first side 101, more portions of the position securing unit 124 pop out. In one embodiment, as shown in FIG. 5, the top portion 120 can rotate 180 degrees from the first side 101 and is fully extended. More importantly, the position securing unit 124 fully pops out at this time and is blocked by an outer edge 113 of the base 110 to secure the top portion 120 and the base 110 in a linear configuration, so the top portion 120 can no longer be moved. Namely, when the top portion 120 is fully extended away from the first side 101, the position securing unit 124 is blocked by the outer edge 113 of the base 110 and acts as a lock to secure the fully extended position of the top portion 120.

Figure 6:
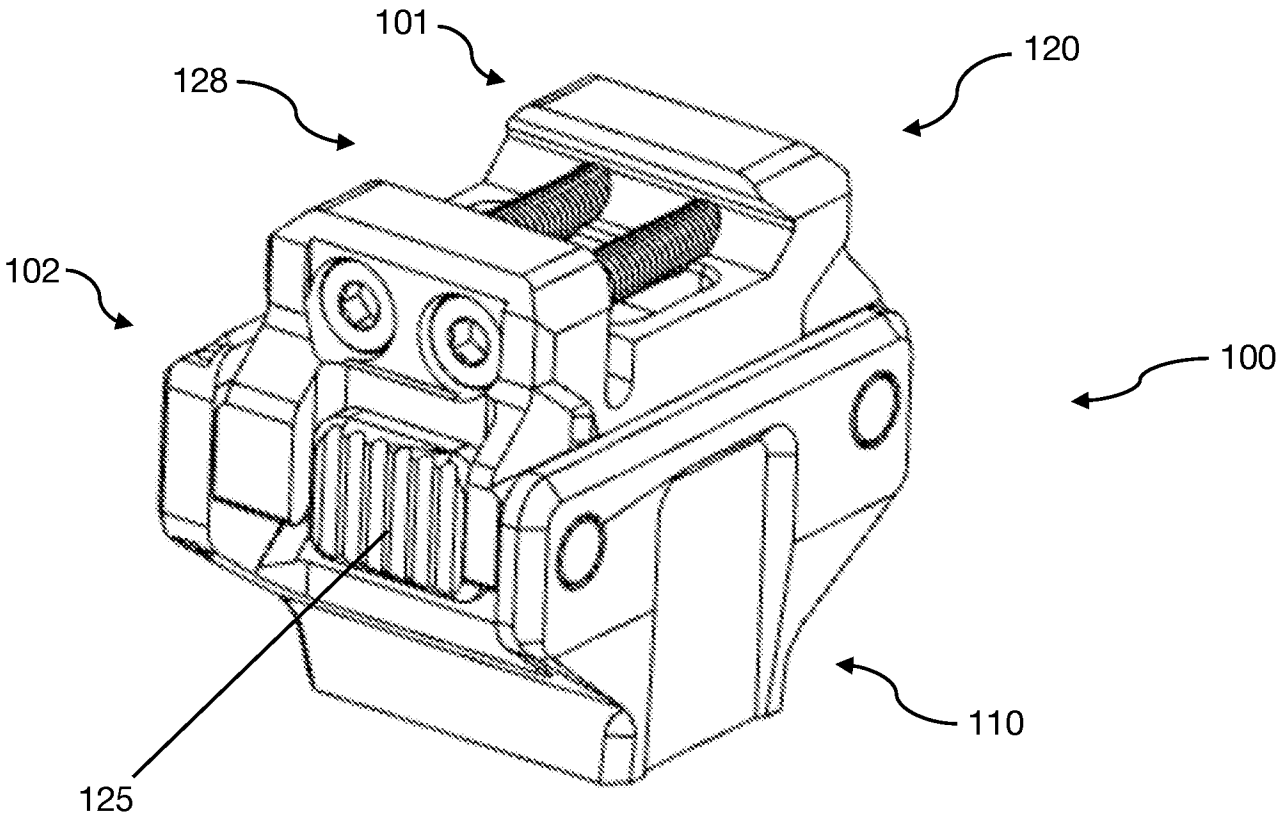
FIG. 6 is a schematic view of a stock-to-firearm adaptor on the second side in the present invention.
Figure 7:
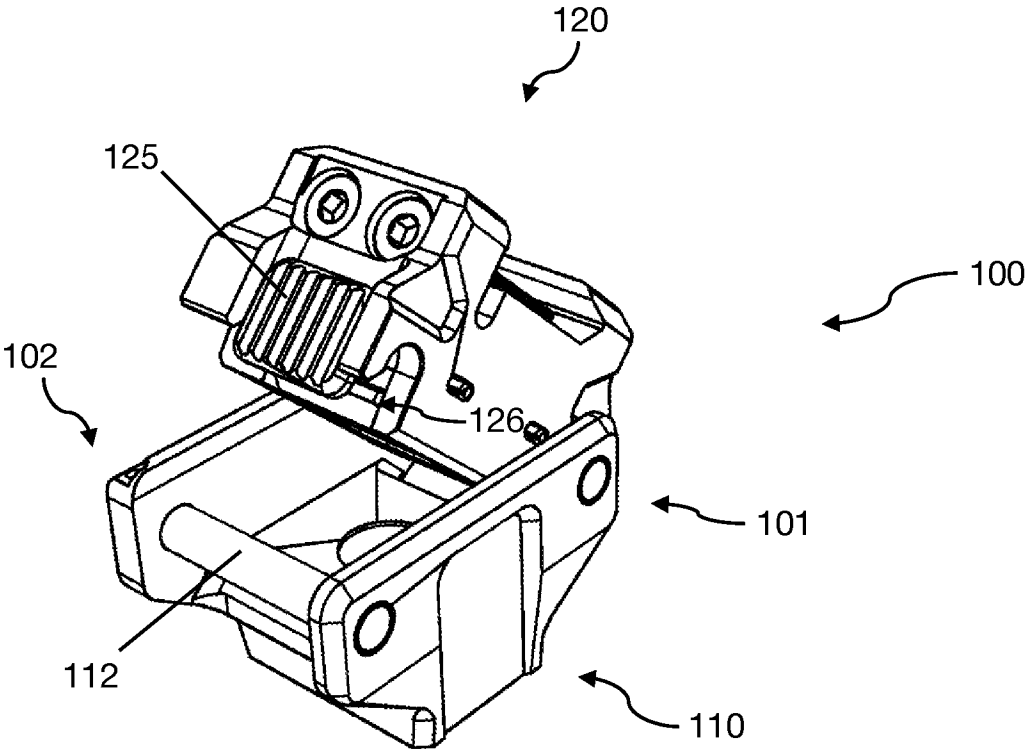
FIG. 7 is a schematic view of the stock-to-firearm adaptor when the top portion is lifted away from the second side in the present invention.
Figure 9:
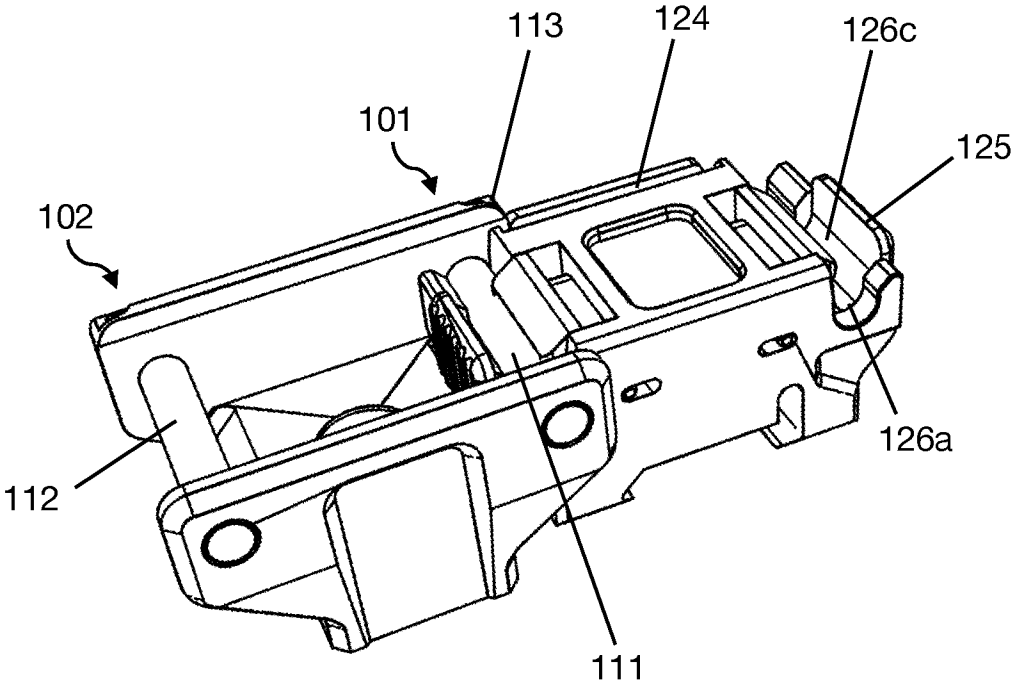
FIG. 9 illustrates a schematic view of the stock-to-firearm adaptor when the top portion is lifted away from the second side and reaches the fully extended position in the present invention.

Likewise, as shown in FIGS. 6 and 7, the top portion 120 can be lifted from the second side 102, while the first engaging groove 122 is engaging with the first connecting bar 111 to pivotally connect the top position to the first side 101 of the base 110. More specifically, as shown in FIG. 8, the top portion 120 on the second side 102 may include a second engaging groove 126, which may include two side grooves (126*a*, 126*b*) and a center groove 126*c*. It is noted that the center groove 126*c* is formed at an inner portion of the second button 125 and when the button 125 is not pressed, the center groove 126*c* is actually misaligned with the two side grooves (126*a*, 126*b*) as shown in FIG. 9. Similarly, when the second button 125 is pressed, the center groove 126*c* is aligned with the two side grooves (126*a*, 126*b*) to form the second engaging groove 126, and when the first engaging groove 126 is formed, the top portion 120 can either engage or disengage with the second connecting bar 112 at the base 110 on the second side 102 to either secure the top portion 120 to the base 110 on the second side 102, or lift the top portion 120 from the base 110 on the first side 102 as shown in FIG. 7.

It is noted when the second button 125 is released, the center groove 126*c* again misaligns with the two side grooves (126*a*, 126*b*) to secure the second connecting bar 112. Furthermore, a second stopping edge 127 is formed near the center groove 126*c*, and the second connecting bar 112 would be blocked by the second stopping edge 127 when the second button 125 is released to prevent the second connecting bar 112 from inadvertently disengaging from the second engaging groove 126. In one embodiment, the second stopping edge 127 may include a second evading surface 127*a* to facilitate the engagement of the second engaging groove 126 and the second connecting bar 112 as shown in FIG. 8.

As shown in FIGS. 7 to 9, one side of the top portion 120 can be lifted up and away from the second side 102 of the base 110 while the other side is pivotally connected to the first connecting bar 111 of the base through the first connecting groove 122. As the top portion 120 pivotally rotating away from the second side 102, more portions of the position securing unit 124 pop out. As shown in FIG. 9, the top portion 120 can rotate 180 degrees from the second side 102 and is fully extended. More importantly, the position securing unit 124 fully pops out at this time and is blocked by an outer edge 113 of the base 110 to secure the base 110 and the top portion 120 in a linear configuration, so the top portion 120 can no longer be moved. Namely, when the top portion 120 is fully extended away from the second side 102, the position securing unit 124 is blocked by the outer edge 113 of the base and acts as a lock to secure the fully extended position of the top portion 120.

Figure 10:
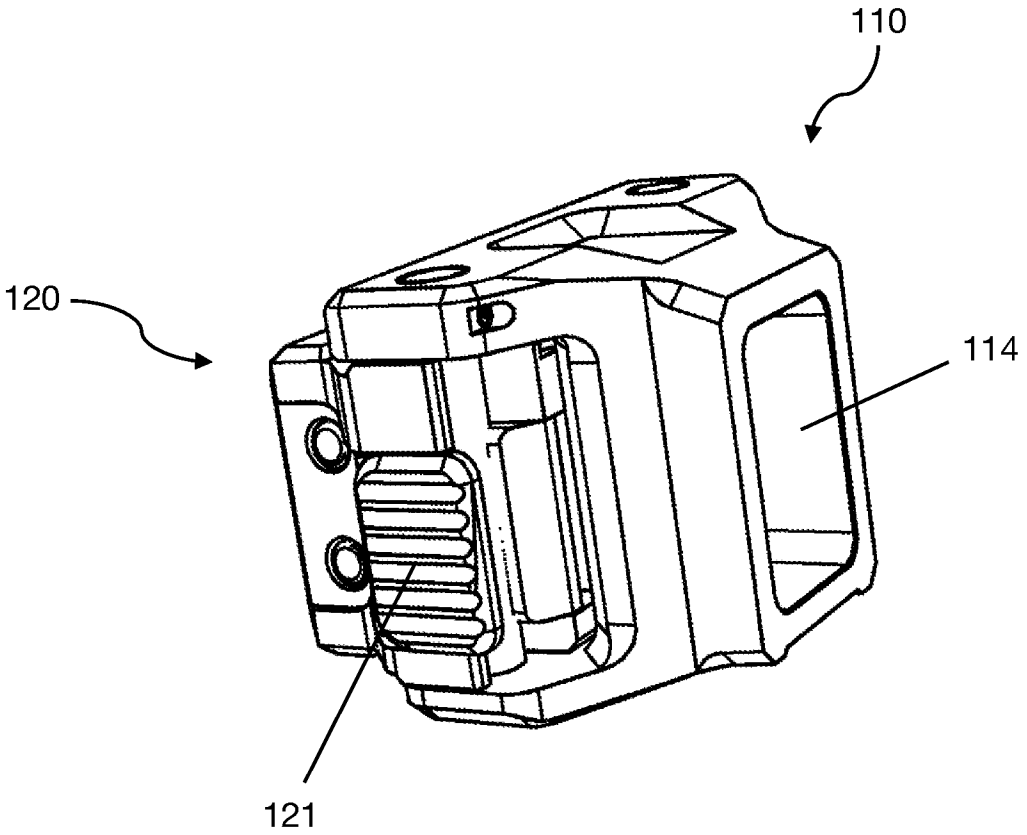
FIG. 10 is a schematic view of a stock-to-firearm adaptor from another angle in the present invention.
Figure 11:
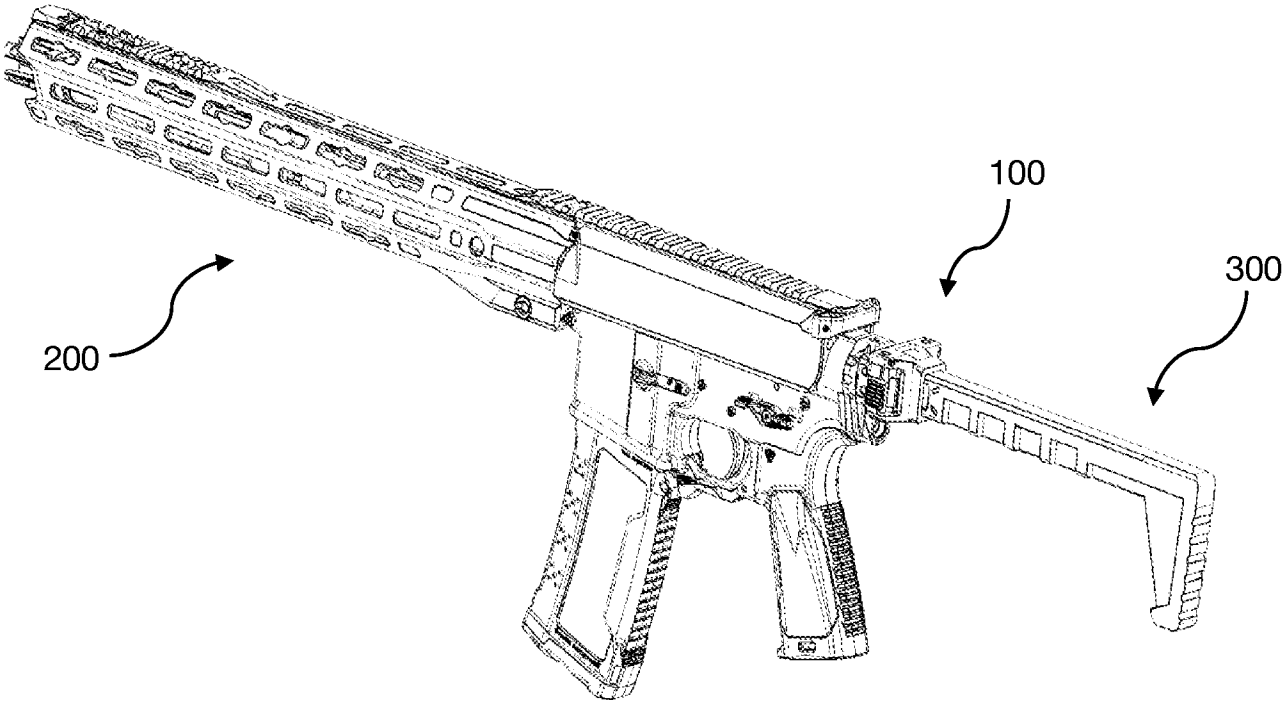
FIG. 11 is a schematic view of the stock-to-firearm adaptor as an interface to connect a firearm and a stock in the present invention.
Figure 12:
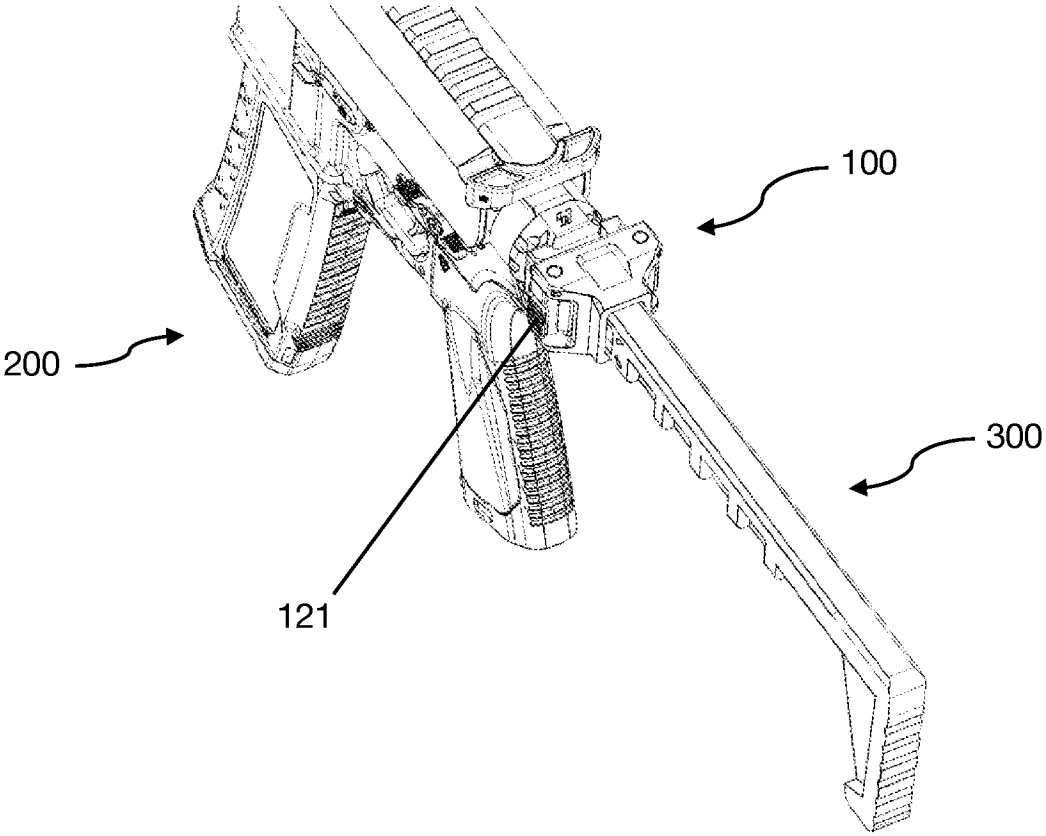
FIG. 12 is a partial enlarged view of the stock-to-firearm adaptor as an interface to connect a firearm and a stock in the present invention.

Referring to FIGS. 1 and 10, stock-to-firearm adaptor 100 is configured to be an interface of the firearm and the stock. In one embodiment, the base 110 may include a stock receiving hole 114 to receive a stock 300, while the top portion 120 may include a firearm attaching assembly 128 to couple the top portion 120 to a firearm 200 as shown in FIGS. 11 and 12.

Figure 13:
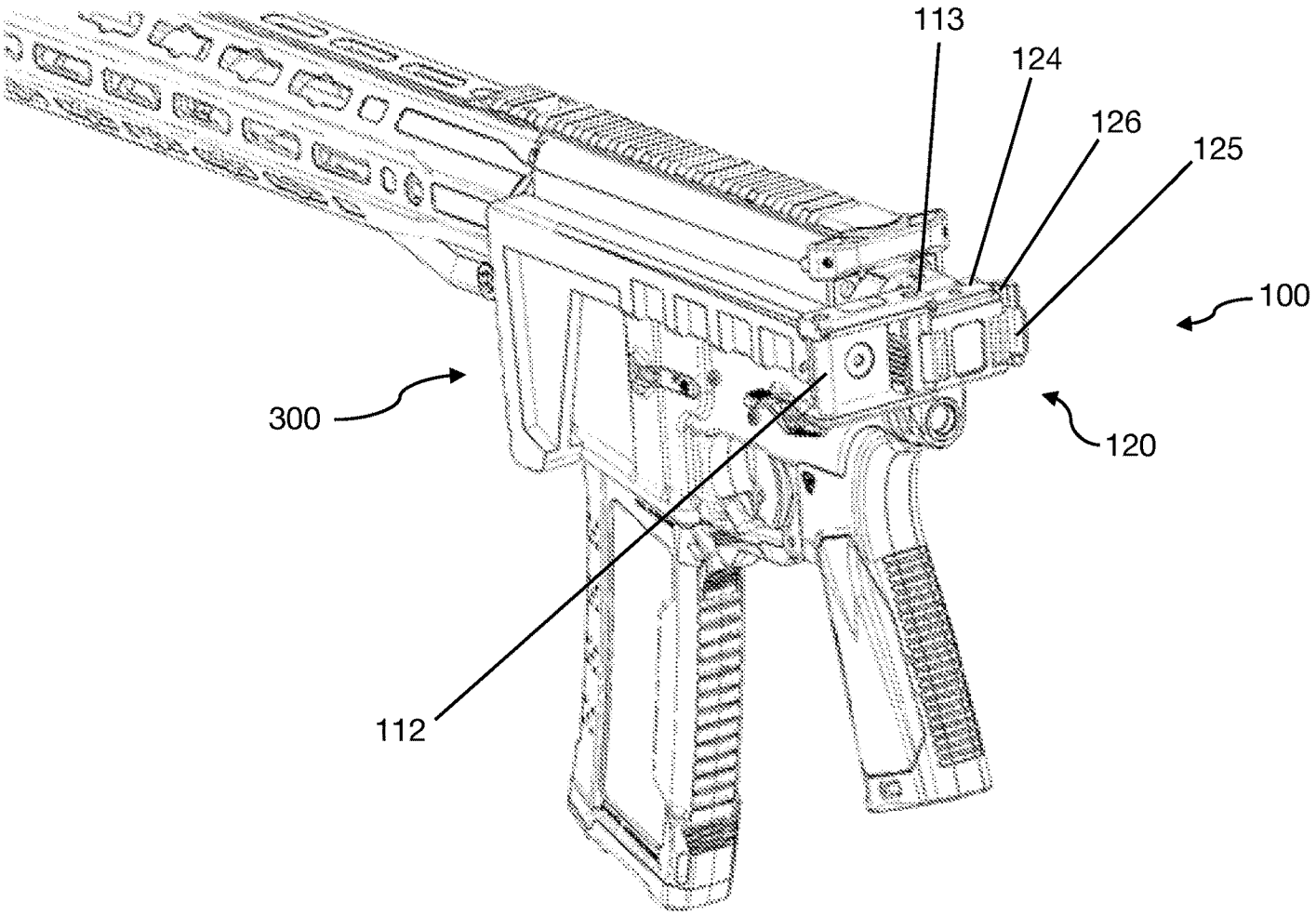
FIG. 13 is a schematic view of the stock-to-firearm adaptor to enable the stock to rotate to one side of the firearm.

As discussed above, by pressing either the first button 121 or the second button 125, the top portion 120 can rotate through the pivotal connection of the top portion 120 and the base 110 on the second side 102 and the first side 101, respectively. In other words, if the top portion 120 is fixed, the base 110 can also rotate through the pivotal connection of the top portion 120 and the base 110. In one embodiment, as shown in FIG. 13, the adaptor 100 is fixed to the firearm 200 through the firearm attaching assembly 128 and user can press the second button 125 to disengage the second engaging groove 126 and the second connecting bar 112, so the base 110 along with the stock 300 can be rotated in a clockwise manner to one side of the firearm 200. In one embodiment, when the base 110 with the stock 300 rotates 180 degrees, the position securing unit 124 pops out to lock the base 110 with the stock 300 to the fully extended position on one side of the firearm 200. Namely, the stock 300 is in a first folded configuration when the base 110 is rotated to the fully extended position on one side of the firearm 200. It is noted that the position securing unit 124 can be pressed to disengage with the outer edge 113, and the base 110 can be rotated back to the top portion 120 in a counter-clockwise manner to the closed configuration to simultaneously bring the stock 300 back to its normal position that is ready for the user to shoot.

Figure 14:
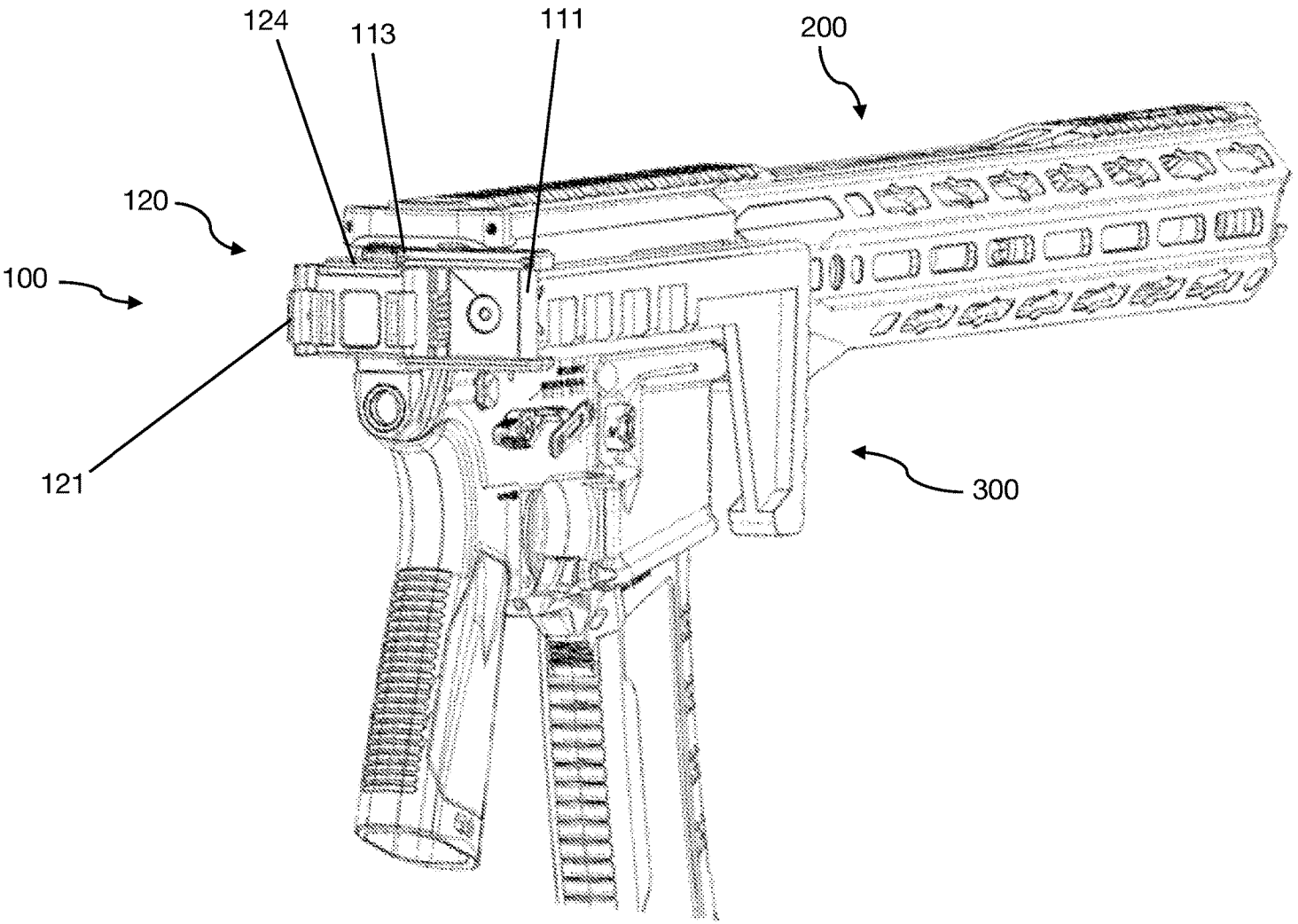
FIG. 14 is a schematic view of the stock-to-firearm adaptor to enable the stock to rotate to another side of the firearm.

Likewise, as shown in FIG. 14, the user can press the first button 121 to disengage the first engaging groove 122 and the first connecting bar 111, so the base 110 along with the stock 300 can be rotated in a counter-clockwise manner to the other side of the firearm 200. In one embodiment, when the base 110 with the stock 300 rotates 180 degrees, the position securing unit 124 pop out to lock the base 110 with the stock 300 to the fully extended position on the other side of the firearm 200. Namely, the stock 300 is in a second folded configuration when the base 110 is rotated to the fully extended position on the other side of the firearm 200. It is noted that the position securing unit 124 can be pressed to disengage with the outer edge 113, and the base 110 can be rotated back to the top portion 120 in a clockwise manner to the closed configuration to simultaneously bring the stock 300 back to its normal position that is ready for the user to shoot.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A foldable stock for a firearm comprising an adaptor configured to connect the firearm and the stock, said adaptor having a base and a top portion that are pivotally connected, and the top portion of the adaptor attached to the firearm while the base of the adaptor is connected to the stock, wherein the base has a first connecting bar located at a first side and a second connecting bar located at a second side; the top portion has a first button and a second button that are resiliently connected with the top portion; the top portion further includes a first engaging groove and a second engaging groove configured to pivotally engage with the first connecting bar and the second connecting bar respectively, wherein when the first button is pressed, the first connecting bar of the base can be disengaged with the first engaging groove of the top portion while the second engaging groove is pivotally engaging with the second connecting bar, and the base with the stock can be detached from the top portion that is attached with the firearm to rotate toward one side of the firearm, and wherein when the second button is pressed, the second connecting bar of the base can be disengaged with the second engaging groove of the top portion while the first engaging groove is pivotally engaging with the first connecting bar, and the base with the stock can be detached from the top portion that is attached with the firearm toward the other side of the firearm.

2. The foldable stock for the firearm of claim 1, wherein the first engaging groove has a center groove located at an inner portion of the first button, and two side grooves which are misaligned with the center groove to secure the first connecting bar in the first engaging groove, and when the first button is pressed, the center groove aligns with said two side grooves and the first connecting bar of the base with the stock can be detached from the first engaging groove of the top portion on the first side.

3. The foldable stock for the firearm of claim 1, wherein the second engaging groove has a center groove located at an inner portion of the second button, and two side grooves which are misaligned with the center groove to secure the second connecting bar in the second engaging groove, and when the second button is pressed, the center groove aligns with said two side grooves and the second connecting bar of the base with the stock can be detached from the second engaging groove of the top portion on the second side.

4. The foldable stock for the firearm of claim 1, wherein the top portion includes a firearm attaching assembly to couple the top portion to the firearm.

5. The foldable stock for the firearm of claim 1, wherein the base includes a stock receiving hole to receive the stock.

6. The foldable stock for the firearm of claim 2, wherein a first stopping edge is formed near the center groove, and the first connecting bar would be blocked by the first stopping edge when the first button is released to prevent the first connecting bar from inadvertently disengaging from the first engaging groove.

7. The foldable stock for the firearm of claim 6, wherein a second stopping edge is formed near the center groove, and the second connecting bar would be blocked by the second stopping edge when the second button is released to prevent the second connecting bar from inadvertently disengaging from the second engaging groove.

8. The foldable stock for the firearm of claim 6, wherein the first stopping edge includes a first evading surface to facilitate the engagement of the first engaging groove and the first connecting bar.

9. The foldable stock for the firearm of claim 7, wherein the second stopping edge includes a second evading surface to facilitate the engagement of the second engaging groove and the second connecting bar.

10. The foldable stock for the firearm of claim 1, the top portion further includes a position securing unit which is resiliently connected to a sidewall of the top portion and located between the sidewall of the top portion and one side of an inner sidewall of the base; and when the top portion is engaged with the base, the position securing unit is being pressed into the sidewall of the top portion to form a portion thereof.

11. The foldable stock for the firearm of claim 10, wherein when the top portion is lifted and extends by rotating away from either the first side or the second side, a portion of the position securing unit pops out from the sidewall of the top portion because of the resilient force, and the position securing unit is configured to completely pop out to secure the top portion and the base in a linear configuration.

12. The foldable stock for the firearm of claim 11, wherein the base includes an outer edge to block the position securing unit from further movement.

* * * * *